US010621942B2

(12) United States Patent
Ruan et al.

(10) Patent No.: US 10,621,942 B2
(45) Date of Patent: Apr. 14, 2020

(54) OUTPUT SHORT CIRCUIT PROTECTION FOR DISPLAY BIAS

(71) Applicant: TEXAS INSTRUMENTS INCORPORATED, Dallas, TX (US)

(72) Inventors: Chenjie Ruan, Shanghai (CN); Zheren Lai, Shanghai (CN); Sang Kwon Kim, Seoul (KR); Yonghua Zhou, Shanghai (CN)

(73) Assignee: Texas Instruments Incorporated, Dallas, TX (US)

( * ) Notice: Subject to any disclaimer, the term of this patent is extended or adjusted under 35 U.S.C. 154(b) by 208 days.

(21) Appl. No.: 13/832,451

(22) Filed: Mar. 15, 2013

(65) Prior Publication Data

US 2013/0328854 A1 Dec. 12, 2013

Related U.S. Application Data

(60) Provisional application No. 61/656,406, filed on Jun. 6, 2012.

(51) Int. Cl.
*G09G 3/36* (2006.01)

(52) U.S. Cl.
CPC ..... *G09G 3/3696* (2013.01); *G09G 2330/02* (2013.01)

(58) Field of Classification Search
None
See application file for complete search history.

(56) References Cited

U.S. PATENT DOCUMENTS

| | | | | |
|---|---|---|---|---|
| 6,515,434 | B1 * | 2/2003 | Biebl | 315/291 |
| 7,994,757 | B2 * | 8/2011 | Motomori | H02M 1/32 323/222 |
| 8,487,924 | B2 * | 7/2013 | Jin et al. | 345/212 |
| 2002/0064008 | A1 * | 5/2002 | Hennig et al. | 361/58 |
| 2004/0195978 | A1 * | 10/2004 | Horiuchi et al. | 315/291 |
| 2007/0019350 | A1 * | 1/2007 | Blackwell | 361/93.1 |
| 2007/0285031 | A1 * | 12/2007 | Shteynberg et al. | 315/294 |
| 2008/0136342 | A1 * | 6/2008 | Tamegai | H02M 3/33507 315/209 R |
| 2008/0164828 | A1 * | 7/2008 | Szczeszynski | G05F 1/46 315/300 |
| 2008/0231247 | A1 * | 9/2008 | Uehara | 323/284 |
| 2009/0002901 | A1 * | 1/2009 | Matsumoto et al. | 361/18 |
| 2009/0021467 | A1 * | 1/2009 | Gohara | 345/102 |
| 2009/0045759 | A1 * | 2/2009 | Kang et al. | 315/307 |
| 2009/0251118 | A1 * | 10/2009 | Omi | 323/282 |
| 2009/0302776 | A1 * | 12/2009 | Szczeszynski | H05B 33/0815 315/246 |

(Continued)

*Primary Examiner* — Benjamin X Casarez
(74) *Attorney, Agent, or Firm* — Tuenlap Chan; Charles A. Brill; Frank D. Cimino

(57) ABSTRACT

A display power circuit is provided. The display power circuit includes a power supply circuit that receives an input voltage and generates an output voltage to power a display. A power switching device couples the output voltage from the power supply circuit to provide a display voltage for the display. A monitor circuit generates a shut down signal based on a change of the output voltage relative to the input voltage exceeding a predetermined threshold indicating a short circuit condition of the display voltage. A control circuit disables the power switching device based on the shut down signal if the short circuit of the display voltage is detected.

9 Claims, 3 Drawing Sheets

(56) References Cited

U.S. PATENT DOCUMENTS

| | | | | |
|---|---|---|---|---|
| 2010/0102750 | A1* | 4/2010 | Cheon | H05B 33/0815 315/291 |
| 2010/0110593 | A1* | 5/2010 | Kim | H02M 1/32 361/18 |
| 2010/0123978 | A1* | 5/2010 | Lin | H02H 7/1213 361/18 |
| 2010/0188784 | A1* | 7/2010 | Young | 361/18 |
| 2011/0018914 | A1* | 1/2011 | Ishikawa et al. | 345/691 |
| 2012/0032938 | A1* | 2/2012 | Park | 345/211 |
| 2012/0074845 | A1* | 3/2012 | Aoki | H05B 33/0845 315/119 |
| 2012/0162279 | A1* | 6/2012 | Kim et al. | 345/690 |
| 2012/0223644 | A1* | 9/2012 | Wang | H05B 33/0887 315/127 |
| 2012/0286756 | A1* | 11/2012 | Tsukiji | H02M 3/158 323/284 |
| 2012/0293562 | A1* | 11/2012 | Park | 345/690 |
| 2013/0141322 | A1* | 6/2013 | Hussain et al. | 345/102 |
| 2013/0234621 | A1* | 9/2013 | Athalye | H02M 3/158 315/307 |
| 2013/0235016 | A1* | 9/2013 | Seo et al. | 345/212 |
| 2014/0146426 | A1* | 5/2014 | Murakami | H03K 19/00315 361/56 |
| 2014/0168567 | A1* | 6/2014 | Kikuchi | H05B 33/0815 349/61 |
| 2016/0198533 | A1* | 7/2016 | Williams | H05B 33/0827 315/185 R |

* cited by examiner

OUTPUT SHORT CIRCUIT PROTECTION FOR DISPLAY BIAS

CROSS-REFERENCE TO RELATED APPLICATION

This application claims the benefit of U.S. Provisional Patent Application 61/656,406 filed on Jun. 6, 2012, and entitled IDLS ANALOG IP SHARING, the entirety of which is incorporated by reference herein.

TECHNICAL FIELD

This disclosure relates to power supply systems, and more particularly to systems and methods to provide short circuit protection for a display power circuit.

BACKGROUND

Electronic displays such as Liquid Crystal Displays (LCD) utilize power supply circuits to power various aspects of the display. The power supply circuits can include powering displays, controlling backlighting, and generating gamma voltages, for example. The displays can include various form factors and technologies that must be integrated with the power supply circuits. The display power supply circuits can include LCD bias circuits, level shifters, scan drivers, and LCD bias integrated with level shifters, for example.

One common circuit configuration for driving a display involves providing output power from the power supply circuit through a power switching device to power the display such as in a display bias application, for example. The output lead of the power switching device is typically coupled to the display and the input lead of the device is typically coupled to a low-forward voltage device such as a Schottky diode which in turn is coupled to a switching inductor for a power supply. The control lead of the power switching device is typically connected to ground during normal display bias operations to enable full power to be delivered through the power switching device to the display. Unfortunately, this type of configuration can cause damage to the power switching device. If the output voltage at the output lead of the power switching device were accidentally shorted to ground, for example, excessive current can flow through the power switching device which could potentially destroy the device.

SUMMARY

This disclosure relates to systems and methods for powering displays and providing short circuit protection for the displays. In one example, a display power circuit is provided. The display power circuit includes a power supply circuit that receives an input voltage and generates an output voltage to power a display. A power switching device couples the output voltage from the power supply circuit to provide a display voltage for the display. A monitor circuit that generates a shut down signal based on a change of the output voltage relative to the input voltage exceeding a predetermined threshold indicating a short circuit condition of the display voltage. A control circuit disables the power switching device based on the shut down signal if the short circuit of the display voltage is detected.

In another example, a method includes boosting an input voltage to generate an output voltage to power a display. The method includes switching the output voltage to provide a display voltage for the display. This includes monitoring the input voltage and the output voltage to detect a change of the output voltage relative to the input voltage exceeding a predetermined threshold indicating a short circuit condition of the display voltage. The method also includes disabling the display voltage if the short circuit of the display voltage is detected.

In yet another example, an integrated circuit includes a boost circuit that receives an input voltage to generate an output voltage to power a display. A comparator monitors the input voltage and the output voltage to detect a short circuit of a display voltage supplied from the boost circuit, wherein the comparator generates a shut down signal based on a change of the output voltage relative to the input voltage exceeding a predetermined threshold indicating a short circuit condition of the display voltage. A latch holds an output based on the state of the shut down signal if the short circuit is detected. A switch is driven from the output of the latch to generate a control signal to disable the display voltage if the short circuit of the display voltage is detected.

DETAILED DESCRIPTION

Figure 1:
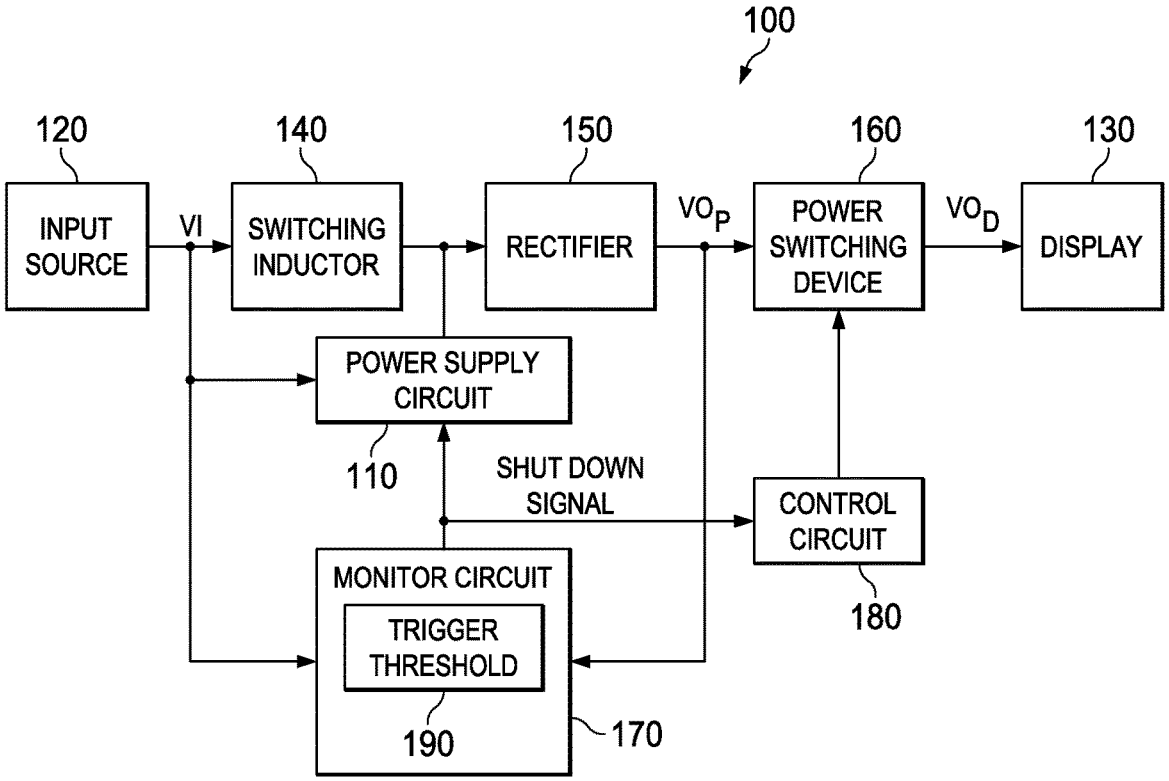
FIG. 1 illustrates a display power system providing short circuit protection for a display power circuit.

FIG. 1 illustrates a display power system 100 providing short circuit protection for a display power circuit. In one example, the system 100 can be provided as a circuit (e.g., integrated circuit, discrete circuit, combination of integrated circuit and discrete circuits) for generating display power and providing short circuit protection. The system 100 includes a power supply circuit 110 that receives an input voltage VI from input source 120 and generates an output voltage shown as $VO_P$ to power a display 130, where the subscript P designates voltage output from a combination of the power supply circuit 110, a switching inductor 140, and rectifier 150. A power switching device 160 couples the output voltage $VO_P$ from the power supply circuit 110 to provide a display voltage $VO_D$ for the display 130, where the subscript D refers to the display voltage.

A monitor circuit 170 monitors the input voltage VI (e.g., some percentage thereof as a threshold) and the output voltage $VO_P$ from the power supply circuit 110 to generate a shut down signal if a short circuit of the display voltage $VO_D$ is detected. For example, a short circuit could occur if a user inadvertently shorted the display 130 by touching a ground signal to the voltage $VO_D$. A control circuit 180 disables the power switching device 160 based on the shut down signal if the short circuit of the display voltage $VO_D$ is detected by the monitor circuit 170. As shown, the monitor circuit 170 can have a defined trigger threshold voltage 190 that determines when the shut down signal is asserted. The shutdown signal can also be supplied to the power supply circuit 110 to disable operations of the circuit during short circuit conditions.

In contrast to prior systems that relied solely on detecting an under-voltage with the input voltage VI, the system 100 monitors both VI and $VO_P$ via the monitor circuit 170 that provides rapid detection of short circuits of display voltage $VO_D$. By providing fast detection of short conditions, the power switching device 160 can be quickly disabled via the shutdown signal and control circuit 180 to protect the power switching device under such conditions. Such detection and switching in the system 100 provides an advantage over prior systems that merely monitored input voltage VI which could potentially lead to damage of the power switching device 160.

In one example, the monitor circuit 170 compares the output voltage $VO_P$ to the threshold trigger voltage 190 that is based on the input voltage VI to detect the short circuit of the display voltage $VO_D$. For example, the threshold trigger voltage 190 can be set to about 0.15V below the input voltage VI to detect the short circuit of the display voltage $VO_D$. As will be described below, the rectifier 150 typically has about 0.3V of forward voltage drop and the threshold trigger voltage 190 can be set to about half that voltage. In another example, the threshold trigger voltage 190 can be set within a range of about 0.10V to about 0.20V below the input voltage VI to detect the short circuit of the display voltage $VO_P$.

As will be described and illustrated below with respect to FIG. 2, in one example, the monitor circuit 170 can be configured as a comparator circuit that monitors the output voltage $VO_P$ from the power supply circuit 110 and the input voltage VI to generate the shutdown signal. The rectifier 150 can be a Schottky diode that supplies the output voltage $VO_P$ of the power supply circuit 110 to the power switching device 160 and to the comparator to enable detection of the short circuit of the display voltage $VO_D$. The control circuit 180 can include a latch that that is triggered by the comparator to hold the display voltage $VO_D$ in a disabled state, for example. Such latching can prevent oscillations and hold the disabled state in the presence of noise, for example. Furthermore, a switch (e.g., PMOS transistor) can be triggered from the latch inside the control circuit, wherein output from the switch disables the power switching device 160 after the latch output state indicates detection of the short circuit of the display voltage $VO_D$.

The power switching device 160 can be a power transistor that couples the output voltage $VO_P$ from the power supply circuit 110 to the display voltage $VO_D$ for the display 130. The power transistor can be a PMOS or an NMOS transistor, for example that couples the output voltage $VO_P$ from the power supply circuit 110 to the display voltage $VO_D$ for the display 130. The power supply circuit 110 can be a boost switching regulator that utilizes the input voltage VI to generate the output voltage $VO_P$ via the switching inductor 140 and rectifier 150. In yet another example that will be illustrated and described below with respect to FIG. 3, the monitor circuit 170 and/or control circuit 180 can be a processor that inputs digital values representing the input voltage VI and the output voltage $VO_P$ to generate the shutdown signal to the power switching device 160 based off a stored value representing a short circuit threshold voltage. Such short circuit protection as described herein can be applied to substantially any type of display 130. For example, a Liquid Crystal Display (LCD) or an Light emitting Diode (LED) display could be employed to receive the display voltage $VO_D$ as a bias for the display 130.

As used herein, the term controller can be a processor operating firmware to control operation of the system 100. In another example, the controller could be a hard-wired function wherein dedicated logic and switching elements control the system. In yet another example, a combination of programmed elements and circuit logic elements could cooperate to perform the operation of the controller and/or other circuit elements in the system 100. In one example, a controller can be configured to monitor voltages VI and $VO_P$ from the power supply circuit 110, to monitor the input source 120, and other control inputs via the monitoring circuit 170 (e.g., monitoring A/D input in the controller, external monitoring circuit providing input to the controller). The monitoring circuit 170 can be an internal operation in the controller such as from an analog to digital converter (ADC) input and/or provided as part of an external circuit to the controller. Also, the control circuit 180 in addition to the monitor circuit 170 can be included within the framework of the controller and/or processing unit.

It is noted that the examples described herein can be provided via different analog and/or digital circuit implementations. For instance, in some cases, field effect transistors can be employed and in other cases junction transistors or diodes employed. Some control components can be employed as discrete implementations such as a comparator comparing a reference signal to a control signal and in other examples, controllers operating via processor instructions and exchanging data via D/A and A/D converters could be employed to monitor voltages and generate control signals and commands within the system 100. The system 100 can employ various means of monitoring electrical parameters such as voltage and current from the input source 120 via the monitor circuit 170. It can also employ a microcontroller or other control circuitry capable of digitizing these parameters, storing digital interpretations of these parameters in its memory, and associating acquired values with events in the system 100 operation. This includes performing logical and arithmetical operations with the acquired values.

Figure 2:
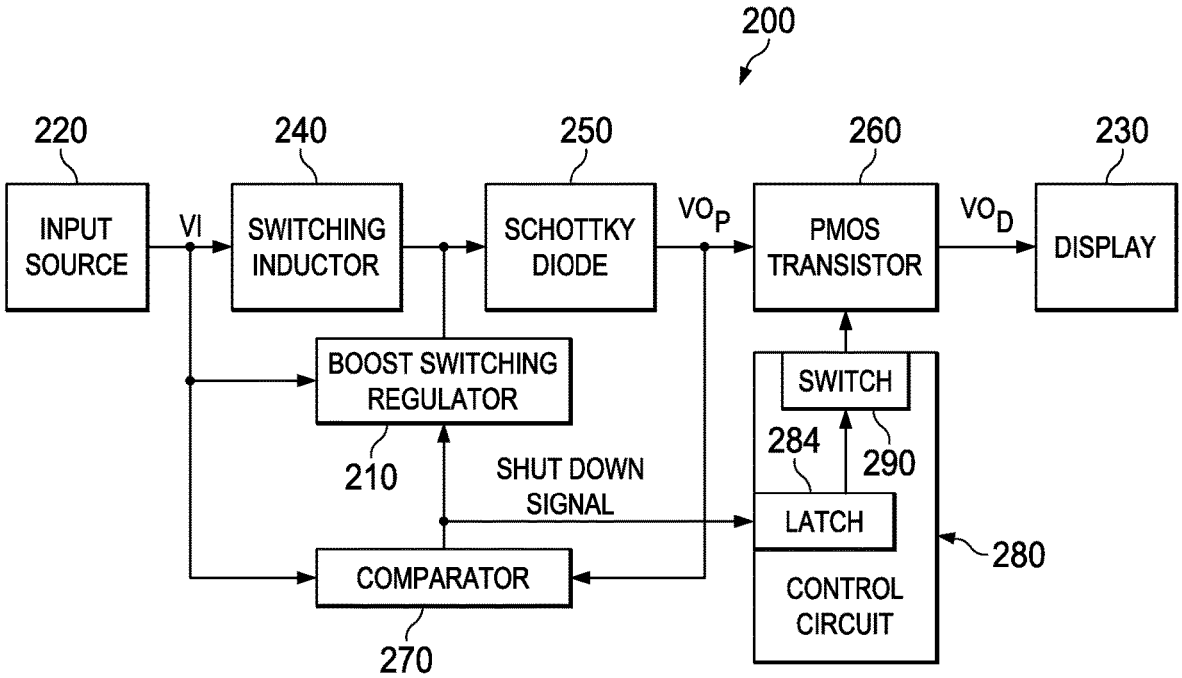
FIG. 2 illustrates a display power system that employs a comparator and latch circuit to provide short circuit protection for a display power circuit.

FIG. 2 illustrates a display power system 200 that employs a comparator and latch circuit to provide short circuit protection for a display power circuit. The system 200 includes a boost switching regulator 210 that receives an input voltage VI from input source 220 and generates an output voltage shown as $VO_P$ to power a display 230, where the subscript P designates voltage output from a combination of the boost switching regulator 210, a switching inductor 240, and Schottky diode 250. A PMOS transistor 260 couples the output voltage $VO_P$ from the boost switching regulator 210 to provide a display voltage $VO_D$ for the display 230, where the subscript D refers to the display voltage.

A comparator 270 monitors the input voltage VI (e.g., some percentage thereof as a threshold) and the output voltage $VO_P$ from the boost switching regulator 210 to generate a shut down signal if a short circuit of the display voltage $VO_D$ is detected. The control circuit 280 disables the PMOS transistor 260 based on the shut down signal if the short circuit of the display voltage $VO_D$ is detected by the comparator 270. The control circuit 280 can include a latch 284 that is triggered by the comparator 270 to hold the display voltage $VO_D$ in a disabled state, for example. Such latching can prevent oscillations and hold the disabled state in the presence of noise, for example. Furthermore, a switch 290 (e.g., PMOS transistor) can be triggered from the latch 284 inside the control circuit 280, wherein output from the switch disables the PMOS transistor 260 after the latch output state indicates detection of the short circuit of the display voltage $VO_D$.

In one example application for the system 200, in an LCD bias application for example, typically a PMOS transistor 260 is placed between the cathode of the Schottky diode 250 and the output to the display 230. In prior systems, the gate of the PMOS transistor was tied to ground during operation and to the output of the boost switching regulator when shutdown. If the output $VO_D$ is shorted to ground however, there can be very large current flowing from VIN through the PMOS transistor 260 to ground, which will normally damage the PMOS transistor.

A short circuit protection circuit including the comparator 270 and control circuit 280 was developed to mitigate short circuit problems. In one example, switch 290 (high pull PMOS transistor) can be implemented between the gate of the external PMOS transistor 260 and its source. When a short circuit condition is detected, the internal switch 290 can deliver large current to quickly discharge the gate of the external PMOS transistor 260. Also, a high voltage comparator 270 can be employed, whose two input terminals can be connected to VIN and the cathode of Schottky diode 250. When the output $VO_D$ is shorted, the output capacitor (shown in FIG. 4) will be discharged first when the output is lower than VIN-Vd, where Vd is the forward voltage of the diode 250. Substantial current can then flow from VIN to $VO_D$ and damage the PMOS transistor 260 when shorted. Thus, it is desirable to select a trigger voltage for the comparator 270. Since the normal forward bias voltage of the Schottky diode 250 is typically less than 0.3V, VIN-0.15V is selected to be the trigger voltage for the comparator 270. By setting the trigger as such, a short condition can be detected and prevent current from flowing from VIN to $VO_D$. In contrast, prior systems rely on the detection of VIN UVLO (under voltage low) to shutdown the external PMOS transistor 260, whereas the system 200 utilizes the detection of VIN-$VO_D$ to shutdown the PMOS transistor 260.

Figure 3:
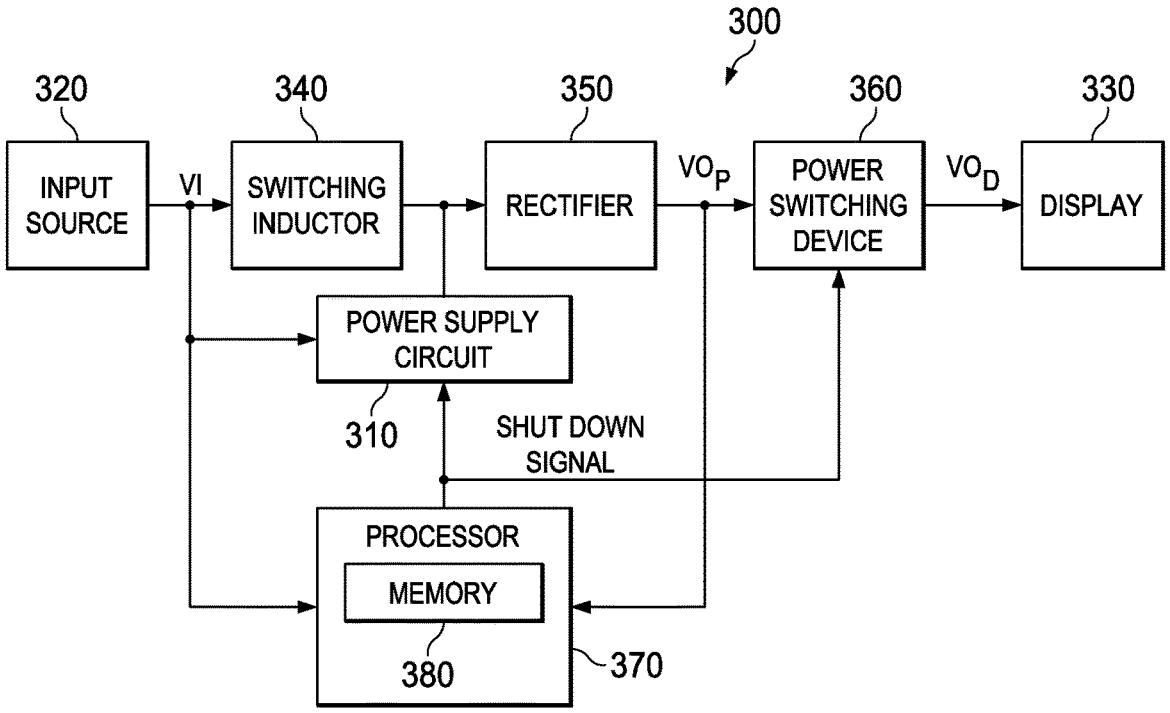
FIG. 3 illustrates a display power system that employs a processor and memory to provide short circuit protection for a display power circuit.

FIG. 3 illustrates a display power system 300 that employs a processor and memory to provide short circuit protection for a display power circuit. The system 300 includes a power supply circuit 310 that receives an input voltage VI from input source 320 and generates an output voltage shown as $VO_P$ to power a display 330, where the subscript P designates voltage output from a combination of the power supply circuit 310, a switching inductor 340, and rectifier 350. A power switching device 360 couples the output voltage $VO_P$ from the power supply circuit 310 to provide a display voltage $VO_D$ for the display 330, where the subscript D refers to the display voltage.

A processor 370 operating instructions from memory 380 monitors the input voltage VI (e.g., some percentage thereof as a threshold) and the output voltage $VO_P$ from the power supply circuit 310 to generate a shut down signal if a short circuit of the display voltage $VO_D$ is detected. The processor 370 disables the power switching device 360 based on the shut down signal if the short circuit of the display voltage $VO_D$ is detected at the processor. The processor 370 can include a latch that is triggered by the processing input data (e.g., VI and $VO_P$) to hold the display voltage $VO_D$ in a disabled state, for example. Such latching can prevent oscillations and hold the disabled state in the presence of noise, for example. As noted previously, the processor 370 can be configured as a controller that utilizes ADC's to read voltages and DAC's set output control signals, for example.

Figure 4:
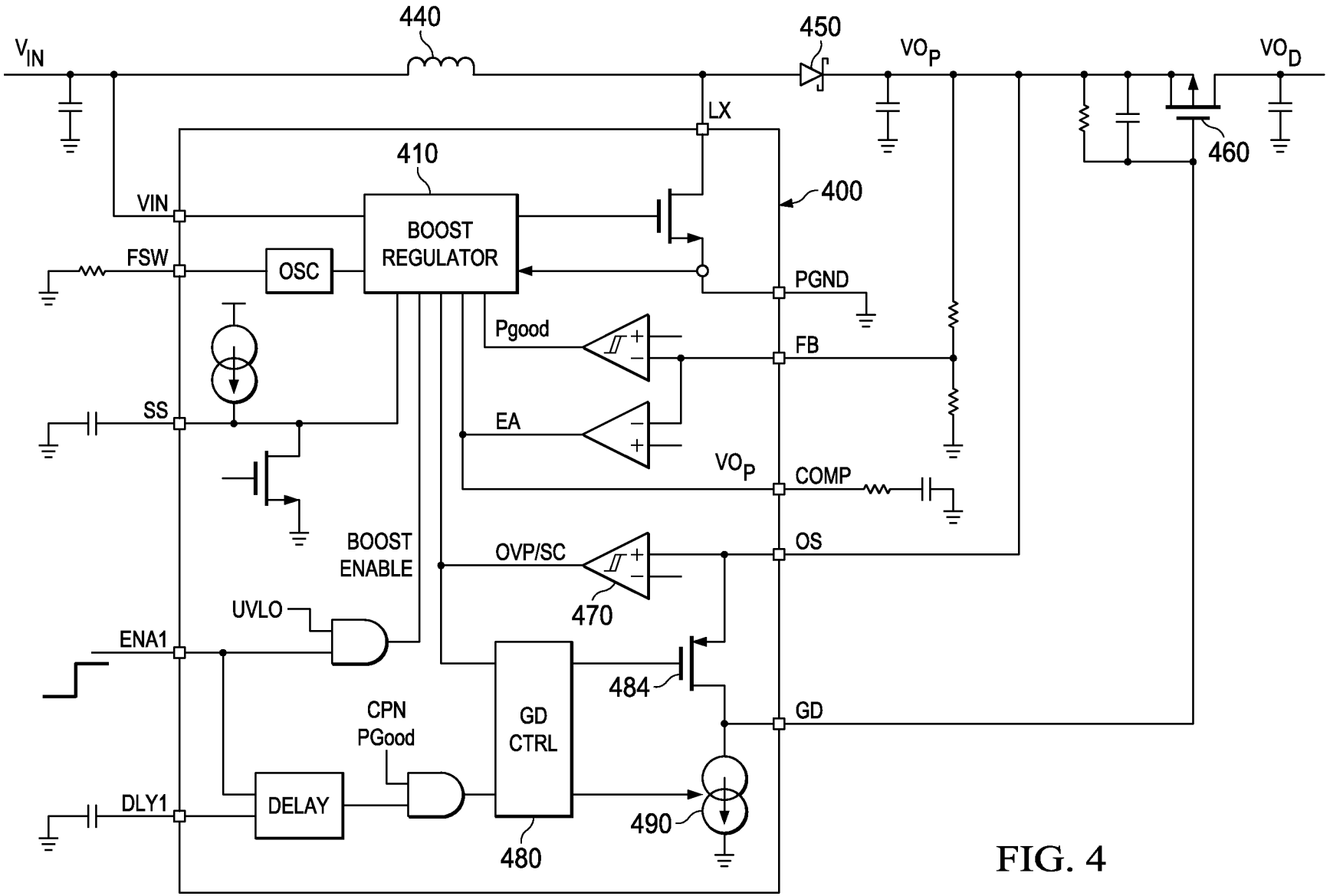
FIG. 4 illustrates a display power integrated circuit to provide short circuit protection for a display.

FIG. 4 illustrates a display power integrated circuit (IC) 400 to provide short circuit protection for a display power circuit. For purposes of brevity, not all components will be described with respect to the IC 400 but only those components relating to the short circuit protection methods described herein. As shown, the IC 400 includes a boost regulator 410 that receives input VIN and utilizes a switching inductor 440 and rectifier 450 to generate an output $VO_P$. A PMOS transistor 460 couples $VO_P$ to an output $VO_D$ for biasing a display (not shown). A comparator 470 monitors $VO_P$ on one input and the other input although not shown as connected functions as a reference trigger voltage that is a function of VIN. Output from the comparator 470 drives a latch 480 which in turn drives an internal PMOS switch 484 which is connected to current sink 490. If a short circuit condition is detected for $VO_D$, the comparator 470 triggers the latch 480 which causes transistor 484 to disable transistor 460. As noted previously, the trigger threshold for the comparator 470 can be set to about VIN-0.15V, for example.

Figure 5:
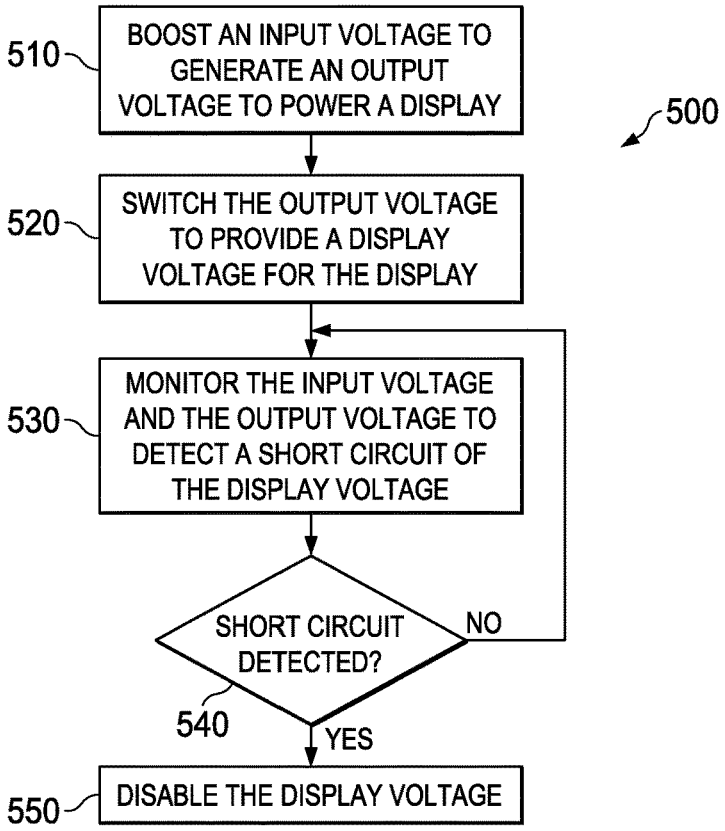
FIG. 5 illustrates a method to provide short circuit protection for a display power circuit.

In view of the foregoing structural and functional features described above, an example method will be better appreciated with reference to FIG. 5. While, for purposes of simplicity of explanation, the example method of FIG. 5 is shown and described as executing serially, it is to be understood and appreciated that the present examples are not limited by the illustrated order, as some actions could in other examples occur in different orders and/or concurrently from that shown and described herein. Moreover, it is not necessary that all described actions be performed to implement a method. The example method of FIG. 5 can be implemented as machine-readable instructions for a controller that can be stored in a non-transitory computer readable medium, such as a computer program product or other form of memory storage. The computer readable instructions corresponding to the method of FIG. 5 can also be accessed from memory and be executed by a processor.

FIG. 5 illustrates a method 500 to provide short circuit protection for a display power circuit. The method 500 includes boosting an input voltage to generate an output voltage to power a display at 510 (e.g., via power supply circuit 110 of FIG. 1). At 520, the method 500 includes switching the output voltage to provide a display voltage for the display (e.g., via power switching device 160 of FIG. 1). At 530, the method 500 includes monitoring the input voltage and the output voltage to detect a change of the output voltage relative to the input voltage exceeding a predetermined threshold indicating a short circuit condition of the display voltage (e.g., via monitor circuit 170 of FIG. 1). At 540, a determination is made as to whether or not a short circuit has been detected via the monitoring at 530. If a short has not been detected at 540, the method 500 proceeds back to 530 and continues to monitor for short circuit conditions. If a short has been detected at 540, the method proceeds to 550. At 550, the method 500 includes disabling the display voltage if the short circuit of the display voltage is detected (e.g., via shutdown signal and control circuit 180 of FIG. 1).

The monitoring in the method 500 can also include comparing the output voltage to a threshold trigger voltage that is based on the input voltage to detect the short circuit of the display voltage. This can include setting the threshold trigger voltage to about 0.15V below the input voltage to detect the short circuit of the display voltage. In another example, this can include setting the threshold trigger voltage to within a range of about 0.10V to about 0.20V below the input voltage to detect the short circuit of the display voltage. The method 500 can also include generating a shut down signal to disable the display voltage if the short circuit of the display voltage is detected and latching the shut down signal to hold the display voltage in a disabled state.

What have been described above are examples. It is, of course, not possible to describe every conceivable combination of components or methodologies, but one of ordinary skill in the art will recognize that many further combinations and permutations are possible. Accordingly, the disclosure is intended to embrace all such alterations, modifications, and variations that fall within the scope of this application, including the appended claims. As used herein, the term "includes" means includes but not limited to, the term "including" means including but not limited to. The term "based on" means based at least in part on. Additionally, where the disclosure or claims recite "a," "an," "a first," or "another" element, or the equivalent thereof, it should be interpreted to include one or more than one such element, neither requiring nor excluding two or more such elements.

What is claimed is:

1. A display power circuit, comprising:

an input terminal configured to receive an input voltage;

a protected output node configured to deliver a protected output voltage;

a comparator circuit having a non-inverting input coupled to the protected output node, an inverting input coupled to receive a threshold voltage referenced from the input voltage, and a comparator output;

a latch having a latch input coupled to the comparator output, a first latch output, and a second latch output;

a switch having a first terminal coupled to the protected output node, a second terminal, and a control terminal coupled to the first latch output;

a current sink adjustable by the second latch output, and coupled between the second terminal of the switch and a ground terminal;

an output terminal configured to deliver an output voltage; and a power switching device having a first terminal coupled to the protected output node, a second terminal coupled to the output terminal, and a second control terminal coupled to the second terminal of the switch.

2. The display power circuit of claim 1, the power switching device comprising an output transistor coupled between the protected output node and the output terminal, the output transistor having the second control terminal coupled to the second terminal of the switch.

3. The display power circuit of claim 2, wherein the threshold voltage is below the input voltage by a margin for detecting a short circuit between the protected output node and the output terminal.

4. The display power circuit of claim 2, further comprising:

a Schottky diode coupled between the input terminal and the protected output node, wherein:

the Schottky diode has a forward bias voltage; and the threshold voltage is less than the input voltage by one-half of the forward bias voltage.

5. The display power circuit of claim 4, further comprising:

an inductor coupled between the input terminal and the Schottky diode.

6. The display power circuit of claim 2, wherein the output transistor include a PMOS transistor.

7. The display power circuit of claim 1, further comprising:

a boost switching regulator coupled between the input terminal and the protected output node.

8. The display power circuit of claim 1, wherein:

the comparator circuit is configured to generate a shutdown signal when the protected output voltage is less than the threshold voltage; and the shutdown signal is configured to disable the current sink and enable the switch.

9. The display power circuit of claim 1, further comprising:

a Liquid Crystal Display (LCD) coupled to receive the protected output voltage.

* * * * *